United States Patent [19]

Mares et al.

[11] 4,087,246

[45] May 2, 1978

[54] FIBER MODIFICATION COMPOSITIONS AND PROCESS

[75] Inventors: Frank Mares, Whippany; Theodore Largman, Morristown, both of N.J.

[73] Assignee: Allied Chemical Corporation, Morris Township, N.J.

[21] Appl. No.: 663,957

[22] Filed: Mar. 4, 1976

[51] Int. Cl.[2] ..... D06M 13/20; D06M 13/40

[52] U.S. Cl. ..... 8/115.5; 8/115.6; 8/115.7; 8/120; 8/DIG. 8; 8/DIG. 11; 8/DIG. 18; 260/75 T; 260/75 N; 260/75 EP; 260/77.5 A; 260/77.5 AN; 260/823; 560/24.76; 560/89

[58] Field of Search ..... 8/115.5, 115.7, DIG. 8, 8/DIG. 11, DIG. 18, 192, 120, 115.6, 471 C; 260/475 A, 475 P, 475 B, 75 T, 75 N, 75 EP, 77.5 AN, 77.5 A, 823

[56] References Cited

U.S. PATENT DOCUMENTS

| | | | |
|---|---|---|---|
| 2,730,427 | 1/1956 | Suen | 8/116 |
| 3,814,578 | 6/1974 | Pittman et al. | 8/127.6 |
| 3,928,420 | 12/1975 | Fang | 260/475 P |
| 3,969,394 | 7/1976 | Reader | 260/471 C |

*Primary Examiner*—John Kight, III

*Attorney, Agent, or Firm*—Robert A. Harman

[57] ABSTRACT

Hydrophilic additives are provided which may be introduced into fibrous articles to provide improved water absorbency and charge dissipation properties which resist abrasion and laundering. The fibrous articles are treated by contacting the articles with at least one hydrophilic additive and nitrogen catalyst under conditions sufficient to incorporate additive and catalyst in the article, followed by heating the treated article to obtain the desired fiber characteristics.

14 Claims, No Drawings

FIBER MODIFICATION COMPOSITIONS AND PROCESS

BACKGROUND OF THE INVENTION

1. Field of the Invention

This invention relates to process and composition for the treatment of fibers or articles fabricated therefrom, and more particularly to process and composition for imparting wettability to artificial fibers, and more specifically to polyethylene terephthalate fibers.

2. Description of the Prior Art

In the past, synthetic fibers have found widespread acceptance in industry and consumer use due to the strength, toughness and higher modulus of these fibers and the goods made therefrom. However, in spite of the positive features, there are also certain properties of synthetic fibers which are objectionable to the consumer. Among these, the fibers are generally hydrophobic and therefore unable to absorb and transport moisture and to dissipate static charge. They also exhibit a propensity to accept and to hold soil deposits. In addition, polyethylene terephthalate fibers, in particular, are difficult to dye with dispersed and water based dyes.

Prior practitioners have attempted to eliminate the negative aspects of synthetic fibers by approximation of natural fibers in their ability to interact with water. In the literature, there are several approaches to this problem: First, hydrophilic polymers are formed by polymerization of new monomers with pendant hydrophilic groups or by copolymerization of the existing monomers with new hydrophilic monomers. Secondly, hydrolysis of the surface of the fiber has been performed in order to form —OH groups on the surface. Also, grafting of hydrophilic units of the fiber surface has been attempted. Finally, polymeric, hydrophilic, water-insoluble finishes have been applied to finished goods made from the synthetic fiber.

The first approach is in fact a rejection of the existing fibers and requires preparation of a completely new fiber, which will result in considerable expense connected with the introduction of a new generic fiber on the market. The second approach, namely that of hydrolysis of the polymer surface, is a very delicate operation and may lead to a lower molecular weight species at the fiber surface, decreasing the stability of these species on washing. Deeper hydrolysis may result in partial degradation of the polymer and therefore further decrease the fiber strength.

Grafting of hydrophilic species such as acrylic acid on the fiber surface is a radical reaction usually initiated by gamma radiation or other high energy sources. The main disadvantage is a lower efficiency of radical formation on the polymer backbone and easy polymerization of acryclic acid into polyacrylic acid without any chemical bonding to the fiber surface.

Finally, the application of polymeric textile finishes normally leads to modifications of low durability on abrasion and usually creates a barrier to subsequent dyeing of the treated fabric. The application of a polymeric textile finish is therefore usually the last operation in manufacture of the final goods. Since the finishes are generally soft plastic polymers, they may serve as soil traps.

SUMMARY OF THE INVENTION

In accordance with the present invention, there are provided hydrophilic additives for imparting wettability and charge dissipation properties to a wide variety of fibers and articles fabricated therefrom. As used herein, the term "fibrous article" is intended to refer to monofilament fibers, fiber bundles and articles fabricated therefrom (e.g., textile fabrics), woven and non-woven. These fiber additives may provide improved wettability, charge dissipation or both to a fibrous article, with various degrees of laundry stability and abrasion resistance, allowing the production of fibrous articles having a wide range of surface properties.

The desired water absorbency can be achieved by: (a) contacting the fibrous article in liquid medium with (1) at least one hydrophilic additive of the present invention and (2) a suitable nitrogen catalyst under conditions sufficient to incorporate additive and catalyst in the article; and (b) heating the treated fibrous article.

It has been found by observation of fiber surfaces using scanning electron microscopy that, by the process of the present invention, hydrophilic additives are incorporated into the fiber surface and become an integral part of the fiber, in contrast to the non-compatible polymeric hydrophilic chemicals of the prior art. The selected hydrophilic additive and nitrogen catalyst are incorporated into the fiber matrix for reaction of the hydrophilic compound near the fiber surface to form oligomeric particles which are entangled in the fiber matrix of the original polymer. Thus, a fiber is produced which tends to retain its wettability and charge dissipation properties longer than fibers provided with polymeric hydrophilic coatings of the prior art since the hydrophilic surfaces formed by the present invention resist being abraded away with wear or laundering.

In addition, it has been surprisingly discovered that the hydrophilic surfaces produced in accordance with the process of the present invention do not prevent dye penetration and, hence, the treated fibrous articles may be subsequently dyed. Moreover, it has been observed that the additives of the present invention do not appreciably transfer from the treated fibrous article to an untreated fabric or fiber, thereby enabling laundering or further processing of the treated fibrous articles together with untreated fabric or fibers without substantial transfer of the hydrophilic additives.

Thus, the additives of the present invention may be incorporated into a fiber, yielding a modified fiber from which a desired fabricated article (e.g., wearing apparel) may be made by use of standard fiber processing steps, such as crimping, twisting, knitting, weaving, etc. without destroying the modified surface properties of the fiber.

DETAILED DESCRIPTION OF THE INVENTION

The hydrophilic additives which may be employed as fiber additives in the practice of the present invention are compounds having per molecule (1) at least two ether linkages, (2) at least one —OH group and (3) at least one epoxide

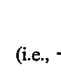

(i.e., $-CH_2-CH_2$)

group. Preferred are compounds falling within the above group which contain at least two epoxide groups and at least two —OH groups per molecule. Thus, there may be employed as the hydrophilic additive such compounds as monofunctional and polyfunctional epoxides, provided the compound(s) selected also contain at least two ether linkages per molecule and at least one —OH group per molecule.

Exemplary of additives which may be employed in the practice of this invention are:

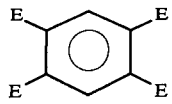

(A)

wherein two E groups are $E_1$, and two E groups are $E_2$, wherein $E_1$ and $E_2$ are the same or different and are selected from the group consisting of $—CON(R_1)_2$, and $—CO_2R_1$ wherein $r$ is an integer of 1 to 5, and $R_1$ is a monovalent radical of the formula $$-\left[(CH_2)_{p_1}-\underset{\underset{T_2}{|}}{(CH)}_{p_2}-(CH_2)_{p_3}-O\right]_m-T_1,$$

wherein $m$ is an integer of 0 to 10; $p_1$, $p_2$ and $p_3$ are each integers and are 0 or 1; $T_2$ is selected from the group consisting of hydrogen, —OH, $—T_1$ and $—OT_1$; $T_1$ is in each occurrence independently selected from the group consisting of radicals of the formula $$-\left[(CH_2)_{p_5}\underset{\underset{D'}{|}}{CH}-(CH_2)_{p_4}-O\right]_{m'}-A_1,$$

wherein $m'$ is an integer of 0 to 10, $p_4$ and $p_5$ are each integers and are 0 or 1, $A_1$ is a member selected from the group consisting of hydrogen, alkyl radicals of 1 to 3 carbon atoms, an epoxide group of the formula

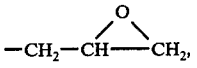

and D' is selected from the group consisting of hydrogen, —OH, alkyl radicals of 1 to 3 carbon atoms and oxyalkyl radicals of 1 to 3 carbon atoms; with the provisos that (1) at least one E group must contain at least one —OH group; (2) at least one of $E_1$ and $E_2$ must contain at least one epoxide group; and (3) when $E_1$ and $E_2$ are the same, $E_1$ and $E_2$ must each be $—CO_2R_2$ wherein $R_2$ is a monovalent radical selected from the group consisting of (i) radicals of the formula $$-CH_2\underset{\underset{OH}{|}}{CH}CH_2O(CH_2CH_2O)_{m''}CH_2\underset{\underset{O}{\diagup\diagdown}}{CH}—CH_2, \text{ and}$$

(ii) radicals of the formula $$-(CH_2\underset{\underset{OH}{|}}{CH}CH_2O)\,(CH_2\underset{\underset{OH}{|}}{CH}CH_2O)_{m''}CH_2\underset{\underset{O}{\diagup\diagdown}}{CH}—CH_2,$$

wherein $m''$ is an integer of from 3 to 8;

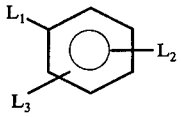

(B)

wherein $L_1$, $L_2$ and $L_3$ are independently selected from the group consisting of $—CON<R_1)_2$ and $—CO_2R_1$ wherein $R_1$ is as defined above, with the provisos that (1) at least one of $L_1$, $L_2$ and $L_3$ must contain at least one —OH group; (2) when $L_1$ and $L_2$ are not the same, at least one of $L_1$, $L_2$ and $L_3$ must comprise $—CO_2R_1$; (3) at least one of $L_1$, $L_2$ and $L_3$ must contain at least one epoxide group; and (4) when $L_1$, $L_2$ and $L_3$ are the same, they are each $—CO_2R_2$, wherein $R_2$ is as defined above;

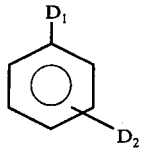

(C)

wherein $D_1$ and $D_2$ are the same or different and are monovalent radicals of the formula $—CO_2R_1$, wherein $R_1$ is as defined above, with the provisos that (1) at least one of $D_1$ and $D_2$ contain at least one —OH group; (2) at least of $D_1$ and $D_2$ must contain at least one epoxide radical; and (3) when $D_1$ and $D_2$ are the same, they are each $—CO_2R_2$, wherein $R_2$ is as defined above; and with the further provisos that (1) when $T_2$ is $—T_1$ or $—OT_1$, $m'$ for $T_2$ cannot be greater than 4; (2) the sum of $p_1$, $P_2$ and $P_3$ must be at least 2; (3) the sum of $p_4$ and $p_5$ must be at least one; and (4) $\Sigma m_i$ must be at least 2; and mixtures thereof.

The term alkyl employed in the definition of the monovalent radicals $A_1$ and D' is meant to include branched and straight-chained radials.

The term "$\Sigma m_i$" employed herein is intended to mean the sum of the integers comprising $m$, $m'$ and $m''$ in each occurrence of these integer variables in the defined $R_1$ and $R_2$ radicals per molecule of hydrophilic additive. As each of these integer variables are associated with groups containing ether linkages, the requirement that "$\Sigma m_i$ must be at least two" ensures that the hydrophilic additive contains at least two ether linkages per molecule of additive.

A preferred range for $m$ is from 0 to 7, and a preferred range for $m'$ is from 0 to 4. Preferably, $T_2$ is selected from the group consisting of hydrogen, —OH and $—OT_1$ and $A_1$ is an isocyanate group, with the integers $m$ and $m'$ being defined by their respective preferred ranges.

Within Class A, $E_1$ and $E_2$ are preferably the same or different and are $—CON(R_1)_2$ or $—CO_1R_2$, and most preferably $—CO_1R_2$, in which $R_1$ is as defined above.

Preferred Class B additives are those in which $L_1$, $L_2$ and $L_3$ are the same or different and are $—CO_1R_2$.

The hydrophilic additives of Class A may comprise one isomer of the Class A formula, e.g., the "para-isomer" in which the $E_1$ groups are in a para position with respect to each other, and thus in which the $E_2$ groups are in the para position with respect to each other; or the "meta-isomer" (in which the $E_1$ groups are in a meta position with respect to each other, and thus in which the $E_2$ groups are in a meta position with respect to each other). Mixtures of Class A isomeric additives, e.g. mixtures of meta- and para-isomers of Class A, may also be employed. Preferably, approximately 50:50 mole mixture of the para- and meta-isomers of Class A additives are employed in accordance with the process of the present invention.

Similarly, each isomeric additive of Class B and Class C may be employed singly or in combination. Preferred hydrophilic additives of Class B are Class B additives in which at least two of $L_1$, $L_2$ and $L_3$ are $—CO_2R_1$, e.g., the para—$CO_2R_1$ Class isomeric additives (wherein $L_1$ and $L_2$ are $—CO_2R_1$ and are located in a para position with respect to each other), and the meta—$CO_2R_1$ Class B additives (wherein the $—CO_2R_1$ groups are in a meta position with respect to each other). Approximately 50:50 molar mixtures of these para-and meta-$CO_2R_1$ Class B additives are especially preferred.

Examples of hydrophilic additives falling within the above classes are as follows:

Class A

| | $E_1$ | | $E_2$ |
|---|---|---|---|
| (1) | $—CO_2CH_2CH(OH)CH_2O(CH_2CH_2O)_nCH_2CH—CH_2$ (epoxide) | n = 3 | (same as $E_1$) |
| (2) | " | wherein n = 4 | " |
| (3) | " | wherein n = 7 | " |
| (4) | " | wherein n = 8 | " |
| (5) | $—CO_2(CH_2CH(OH)CH_2O)_2CH_2CH—CH_2$ (epoxide) | | " |
| (6) | $—CO_2(CH_2CH_2O)_7CH_3$ | | $—CO_2CH_2CH(OH)CH_2O(CH_2CH_2O)_6—CH_2CH—CH_2$ (epoxide) |
| (7) | $—CO_2(CH_2CH(OH)CH_2O)_2CH_2CH—CH_2$ (epoxide) | | $—CON(CH_2CH_2O)_5C_2H_5)(CH_2CH_2O)_5C_2H_5$ |

Class B (8)

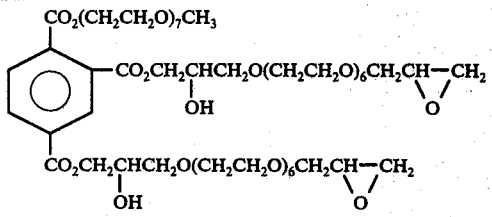

(9)

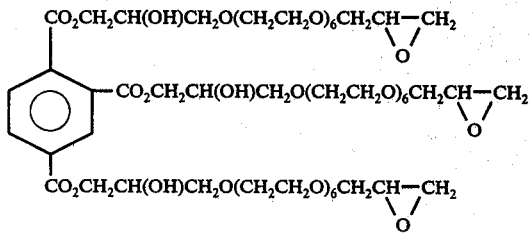

(10)

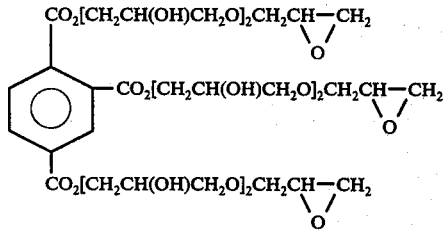

(11)

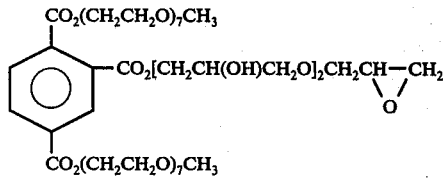

(12)

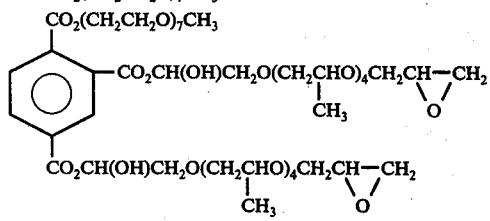

-continued (13)

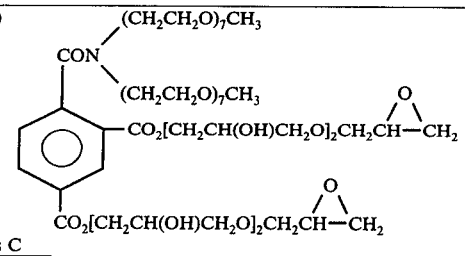

Class C

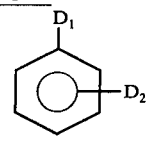

with $D_2$ in ortho-, meta-, or para-position, wherein (14)

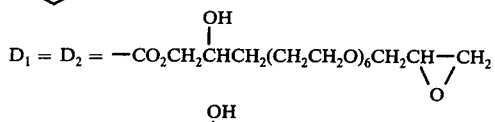

(15)

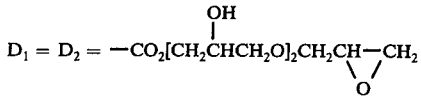

(16)

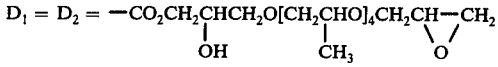

In addition to having the foregoing chemical structure, the hydrophilic additive must also possess certain physical properties. The additives must be substantially thermally stable at the temperature used in the heat treatment step, which will generally range from about 90° to 230° C. An additive is thermally stable if it survives the heat treatment process without forming undesirable heat decomposition products and without decomposing to such an extent as to lose an appreciable amount of the effectiveness in imparting wettability and anti-static properties to the filament. In addition to being thermally stable, the additive must be also nonfugitive, i.e., not appreciably volatile, at the selected heat treatment temperature, otherwise it would escape from the filament. To be suitable, the additive must have a strong ability for hydrogen bonding, as indicated by possessing solubility in polar solvents such as water, methanol or ether solvents (e.g., dioxane).

Suitable nitrogen catalysts which may be used include tertiary amines, (2) amino acids (e.g., ϵ-aminocaproic acid, glycine, lysine, etc.), (3) caprolactam, and (4) mixtures thereof. Suitable tertiary amines include amines wherein the N–H hydrogens are substituted by members selected from the group consisting of alkyl radicals of 1 to 5 carbon atoms, aryl radical, alkyl-substituted aryl radicals having a total of from 7 to 10 carbon atoms, aryl-substituted alkyl radicals having a total of from 7 to 10 carbon atoms and mixtures thereof and heterocyclic amines having from 5 to 9 ring carbon atoms. Examples of these tertiary amines are butyldimethylamine, trimethylamine tributylamine, tripentylamine, dimethyl-sec-butylamine, benzyldiphenylamine, benzylethylphenylamine, benzylethyl 2-tolylamine, tribenzylamine and pyridines and piperidines wherein the N–H hydrogen is substituted by alkyl having from 1 to 5 carbon atoms or aryl.

Fiber Preparation

In accordance with the process of the present invention, a fibrous article is contacted with the selected hydrophilic additive and nitrogen catalyst, followed by heating the treated article for reaction of additive within the fibrous article to achieve the desired fiber properties.

It is preferred that the article be contacted for absorption of additive and nitrogen catalyst therein. However, this is not required, and the additive and catalyst may be adsorbed on the surface of the fibrous article since it has been found that both adsorbed and absorbed additive will, during the subsequent heating step, penetrate the article and react therein to provide the desired hydrophilic fibrous article. As used herein, therefore, the terms "incorporated into" and "incorporate in" (as applied to the presence of additive and catalyst on or in a fibrous article) are intended to include both adsorption and absorption of additive and catalyst.

The selected hydrophilic additive and nitrogen catalyst may be employed in an organic or a substantially neutral-pH aqueous medium (e.g., a pH of from 6 to 8) in a wide variety of concentrations. While the amount of additive incorported into the liquid medium for contact of the fibrous article will of course, vary widely depending upon the additive selected, the fiber to be treated, the fiber properties desired, and other factors, the additive is generally incorporated into the liquid medium in an amount of from about 0.1 to 5% by weight, and most preferably from about 0.5 to 2% by weight. Nitrogen catalyst is generally used in an amount of from about 0.1 to 5 weight percent, based on the total weight of additive in the liquid medium. However, larger or smaller amounts of nitrogen catalyst may also be used.

Thus, the fibrous article may be contacted with the selected additive and catalyst by several methods. For example, the article may be contacted with (1) an aqueous solution of the additive containing the nitrogen catalyst, or (2) an organic solvent containing the catalyst and having the additive dissolved therein. The temperature of the liquid medium used to treat the article and the time for which the article is contacted with the liquid medium is also not critical. Generally, however, the temperature will vary from about 10° to 60° C, and preferably from about 15° to 40° C., and the time from about 0.01 to 1 hour, and preferably from about 0.05 to 0.5 hours. However, higher and lower temperatures and shorter and longer contact times may be employed with advantageous results.

The amount of hydrophilic additive to be incorporated into the fibrous article by the present invention will vary widely depending upon the additive selected, the surface properties sought, the fiber treated, and other factors. Generally, however, the hydrophilic additive is incorporated into a fibrous article in an amount of up to about 5 percent by weight, preferably from about 0.5 to 3 percent by weight, and most preferably from about 1 to 2 percent by weight of the article. Thus, the quantity of hydrophilic additive that is contained in the liquid medium will generally be sufficient to provide a fibrous article having the additive incorporated therein in the above amounts, e.g. up to about 5 percent by weight of the fibrous article.

When it is desired to employ an organic solution of the hydrophilic additive, the organic solvent selected will, of course, depend upon the solubilities of the additive in the solvent. Suitable organic solvents may be easily determined by routine experimentation and include: ethers (e.g., dioxane); ketones (e.g., acetone); alcohols (e.g., isopropanol); chlorinated hydrocarbons (e.g., chloroform); and aromatic and substituted aromatic hydrocarbons (e.g., benzene, toluene and chlorinated benzenes). It is preferred, however, that the organic solvent selected for use not also be a solvent for the fibrous article which is being treated to prevent substantial degradation of the fiber when the additive solution is brought into contact therewith.

The fibrous article may be contacted with a liquid medium containing the selected hydrophilic additive and nitrogen catalyst by any standard method employed in the industry to contact a liquid and fiber filaments or articles fabricated therefrom. In the preferred practice, the fiber is first formed into a fabricated article such as an article of clothing which is then contacted with the liquid medium containing the selected additive.

It will be appreciated that the hydrophilic additives of the present invention may be applied to a fibrous article by spraying the additive thereon, as from an aerosol formulation comprising (1) a liquid medium containing the additive and (2) a suitable aerosol propellant. The precise aerosol formulation selected is, of course, in no way critical to the present invention, and the liquid medium may also contain such surface active agents as are necessary to disperse or dissolve the selected additive in the liquid medium which is employed in the event the additive is not soluble therein.

It will also be appreciated that the fibrous article may be contacted with the liquid medium containing the hydrophilic additive either before, during or after the article is contacted with a liquid medium containing the nitrogen catalyst. Thus, for example, sequential dipping of a fibrous article into separate liquid media containing the additive or nitrogen catalyst may be employed. However, to prevent a subsequent dipping step from solubilizing and washing away additive or catalyst applied in a previous step, sequential dipping is preferably employed only with additive/catalyst systems that have different solubilities using solvents that will not solubilize an ingredient previously applied, and the fibrous article is preferably air dried between dipping steps. For example, as amino acids are soluble in water but insoluble in dioxane, a fibrous article may be treated by sequentially dipping the article into an aqueous solution of the amino acid catalyst and then, preferably after air drying the article, into a dioxane solution containing the selected hydrophilic additive.

Both the aqueous and organic liquid mediums may also contain a dye to enable concurrent dyeing and additive absorption. The dye selected is not critical and dyes such as dispersed dyes (e.g. Resolin Blue FBLB and Nacelan Blue FFRN (C.I. Disperse Blue Three) have been found quite satisfactory. The quantity of dye employed is not critical and may be used in the amounts conventionally employed to obtain the desired shade.

Following treatment of the fibrous article with the selected liquid medium, the article is subjected to a heat treatment, preferably after being air dried, in order to achieve the desired hydrophilic properties. While air drying of the fibrous article is not generally required, the article is preferably air dried prior to annealing to prevent premature inactivation of the epoxide group by reaction with water on the fiber.

The fibrous article contacted with the selected hydrophilic additive and nitrogen catalyst may be heat treated by annealing the fibrous article (e.g., in a circulating or static air oven) under conditions sufficient to effect reaction of the additive molecules absorbed in the fibrous article, that is, for reaction of the epoxide group(s) with the —OH group(s) contained in the hydrophilic additive. The temperature of heat treatment may vary widely, but is generally from about 90° to 230° C., and preferably from about 120° to 150° C. The time of such heat treatment is not critical, but is generally from about 5 seconds to about 240 minutes. Likewise, the pressure in which the annealing heat treatment is performed is not critical and atmospheric pressure has been found to be quite satisfactory.

The present invention advantageously improves the water absorption and/or charge dissipation properties of filaments prepared from any fiber-forming thermoplastic resin, such as polyamide, polyester, polyacrylonitrile and blends thereof. Particularly good results are obtained with polyester fibers and articles fabricated therefrom, especially with fibrous articles containing polyethylene terephthalate and/or polybutylene terephthalate. When polyester fibers and fabricated articles are treated, especially preferred results are obtained using the hydrocarbon ether/hydroxy additives of Class A and Class B.

The hydrophilic additive may be incorporated into the fiber and the fiber heat treated before or after the application of a spin finish to the fiber and before or after crimping or texturizing of the fiber. Spin finishes which may be employed are conventional and should be selected to prevent inclusion of a component of the spin finish which substantially reacts with either the fiber, hydrophilic additive, or nitrogen catalyst. The spin finish may be employed in any amount conventionally used to produce the intended processing characteristics of the extruded fiber. The selected hydrophilic additive and nitrogen catalyst may also be incorporated into a fiber from which the spin finish has been removed, as by employing a conventional scouring process (e.g., washing with a soap solution). However, unscoured fiber may also be treated in accordance with the process of the present invention.

SYNTHESIS OF HYDROPHYLIC ADDITIVES

The hydrophilic additives of the present invention may be prepared by conventional methods. Thus, the additives of Class A may be prepared by reaction of a polyether alcohol with pyromellitic anhydride, followed by reaction of the resulting compound with the desired epoxide compound. Likewise, pyromellitic acid may be reacted with the desired epoxide compound to form Class A additives wherein $E_1$ and $E_2$ are the same and are $—CO_2R_2$, wherein $R_2$ is as defined above for the additives of Class A.

Similarly, Class B additives may be prepared either (1) by reaction of polyether alcohols and trimellitic anhydride followed by reaction of the resulting intermediate with an epoxide compound, or (2) by reaction of trimellitic acid with the selected epoxide compound. The Class C additives may be prepared, for example, by reacting benzene dicarboxylic acid with the selected epoxide compound.

The process of the present invention may be further illustrated by reference to the following examples. In the examples below, the term "laundry cycle" is intended to refer to one washing in an automatic washer (Sears, Kenmore) in hot water (about 140° F) using one cup of Tide detergent at a constant load of 3 pounds. The samples were dried for 30 minutes in an automatic dryer (Sears, Kenmore) at a temperature of about 140°-160° C. Static charge dissipation in the following examples was measured either by use of a voltameter manufactured by Rotchield (Zurich, Switzerland) or by the AATCC cling test, as established by the American Association of Textile Colorists and Chemists.

The ability of a treated fabric to wick with water was determined as follows: a strip of the cloth to be tested 1 inch wide and 10 inches long was marked 1 inch from the bottom by a horizontal line using a lead pencil. From the 1 inch horizontal mark to the top of the strip three parallel vertical lines were made by a marking pen containing ink soluble in water. A weight was placed at the bottom of the cloth strip, and the strip was hung over a dish to which distilled water was then added until the water level reached the 1 inch horizontal mark on the strip. The height of the wicked water level on the strip was then read at the selected time increments, with zero time defined as the moment when water reached the 1 inch horizontal mark.

The wettability of a tested cloth was determined by placing the tested cloth on top of a small glass dish, and placing a drop of water on the cloth using a standard eye dropper (having a diameter of about one-eighth inch). The time required for the drop to spread and be completely absorbed by the cloth is recorded.

EXAMPLES 1-2

In the following Examples, a 10 in × 15 in. sample of single knit cloth, manufactured from polyethylene terephthalate fiber, was thoroughly immersed in a liquid medium containing the selected nitrogen catalyst and a 50:50 mixture of the ortho—$CO_2R_1$ and para—$CO_2R_1$ isomeric additives of Class B wherein $L_1$ and $L_2$ are the same and are each $—CO_2(CH_2CHO)_nCH_3$, wherein average $n = 7$, and $L_3$ is $$—CO_2CH_2\underset{\underset{OH}{|}}{C}HCH_2O(CH_2\underset{\underset{CH_3}{|}}{C}HO)_mCH_2\underset{\underset{O}{\diagup\diagdown}}{CH—CH_2},$$

wherein average $m = 4$.

The liquid contained hydrophilic additive in an amount sufficient to provide a total additive concentration on the cloth, after air drying as described below, of about 1 percent by weight of the cloth. The nitrogen catalyst was employed in the liquid medium in a catalyst-to-additive mole ratio of about 0.1 to 1. After immersion in the liquid, the cloth samples were then hand wrung to remove excess liquid and air dried. The air dried samples were then annealed in a circulating air oven for the indicated time at the selected temperature.

The annealed cloth in each example was then tested to determine charge dissipation, wettability and wicking. The data thereby obtained are set forth in Table I. Attention is drawn to the greatly improved cloth properties as compared to the untreated control sample which was merely immersed in water, hand-wrung, air-dried and annealed at the indicated temperature for 15 minutes.

Table I

| Example No. | Nitrogen Catalyst | Liquid | Annealing Conditions Temp (° C.) | Time (min.) | Charge Dissipation (Sec.) | Wettability (Sec.) | Wicking (Inch) |
|---|---|---|---|---|---|---|---|
| Control | — | water | 160 | 15 | >1800 | >360 | 1.2 |
| 1 | AC | water | 160 | 15 | 68 | 2 | 5.5 |
| 2 | AC | water | 160 | 15 | — | 4 | 5.5 |

AC = ε - amino caproic acid

EXAMPLES 3-4

To determine the effect of washing on cloth treated in accordance with the process of the present invention, cloth samples of double knit Dacron 56 were prepared as in Examples 1 and 2 and tested after annealing to determine wettability, wicking and charge dissipaton. The samples were then subjected to 10 laundry cycles, after which the above values were again determined. The data obtained are set forth in Table II.

Table II

| Example No. | Nitrogen Catalyst | Liquid | Annealing conditions Temp. (° C) | Time (Min.) | Before Washing Wettability (sec) | Wicking (inch) | Charge Dissipation (sec) | After 10 Laundry Cycles Wettability (sec) | Wicking (inch) | Charge Dissipation (sec) |
|---|---|---|---|---|---|---|---|---|---|---|
| 3 | AC | water | 160 | 5 | 1 | 7.5 | 55 | 2 | 7.5 | 1800 |
| | | | | 15 | 2 | 7.8 | 100 | 1 | 7.8 | >1800 |
| | | | | 30 | 1 | 7.9 | 950 | 1 | 7.9 | >1800 |
| | | | | 60 | 1 | 7.8 | 1500 | 1 | 7.8 | >1800 |
| 4 | TBA | dioxane | 160 | 5 | 1 | 7.5 | 143 | 1 | 7.5 | >1800 |
| | | | | 15 | 1 | 7.8 | 225 | 1 | 7.9 | 1275 |

Table II-continued

| Example No. | Nitrogen Catalyst | Liquid | Annealing conditions Temp. (° C) | Time (Min.) | Before Washing Wettability Wicking Charge Dissipation (sec) | (inch) | (sec) | After 10 Laundry Cycles Wettability Wicking Charge Dissipation (sec) | (inch) | (sec) |
|---|---|---|---|---|---|---|---|---|---|---|
| | | | | 30 | 1 | 7.8 | 1085 | 1 | 7.8 | 1150 |
| | | | | 60 | 1 | 7.1 | >1800 | 1 | 7.0 | >1800 |

TBA = tribenzyl amine; AC = epsilon-amino caproic acid

EXAMPLES 5-6

To determine the effect of annealing time on the amount of hydrophilic additive incorporated into cloth treated in accordance with the process of the present invention, double knit Dacron 56 polyester cloth samples were prepared as in Examples 1 and 2 and, after air-drying, were annealed at 160° C. for various time intervals and the percent additive remaining on the cloths after 10 laundry cycles was determined. The concentration of additive on the cloth after annealing and before washing was taken to be 100%. The results of these tests are summarized in Table III, wherein the amount of additive remaining on the cloth is expressed as a function of annealing time and temperature.

Table III

| Ex. No. | Nitrogen Catalyst | Liquid | Annealing Temp. | Weight Percent of Initial Additive Remaining on Cloth After 10 Laundry Cycles: Annealing Time 5 | 15 | 30 | 60 (min) |
|---|---|---|---|---|---|---|---|
| 5 | AC | water | 160° C | 18 | 22 | 44 | 67 |
| 6 | TBA | dioxane | 160° C | 40 | 59 | 68 | 77 |

AC = ε- aminocaproic acid; TBA = tribenzylamine

While there have been described various embodiments of the invention, the methods described are not intended to be understood as limiting the scope of the invention as it is realized that changes therewithin are possible and it is further intended that each element recited in any of the following claims is to be understood as referring to all equivalent elements for accomplishing substantially the same results in substantially the same or equivalent manner, it being intended to cover the invention broadly in whatever form its principle may be utilized.

We claim:

1. A hydrophilic fiber additive comprising a member selected from the group consisting of compounds having the formula:

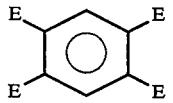

(A)

wherein two E groups are $E_1$, and two E groups are $E_2$, wherein $E_1$ are $E_2$ are the same or different and are selected from the group consisting of $—CON(R_1)_2$, $—CONH(CH_2)_rNCO$ and $—CO_2R_1$ wherein $r$ is an integer of 1 to 5, and $R_1$ is a monovalent radical of the formula $$-\left[(CH_2)_{p_1}-\underset{T_2}{\underset{|}{(CH)}}_{p_2}-(CH_2)_{p_3}-O\right]_m-T_1,$$

wherein $m$ is an integer of 0 to 10; $p_1$, $p_2$ and $p_3$ are each integers and are 0 or 1, $T_2$ is selected from the group consisting of hydrogen, —OH, $—T_1$ and $—OT_1$, $T_1$ is in each occurrence independently selected from the group consisting of radicals of the formula $$-\left[(CH_2)_{p_5}\underset{D'}{\underset{|}{CH}}-(CH_2)_{p_4}-O\right]_{m'}-A_1,$$

wherein $m'$ is an integer of 0 to 10, $p_4$ and $p_5$ are each integers and are 0 or 1, $A_1$ is a member selected from the group consisting of hydrogen, alkyl radicals of 1 to 3 carbon atoms, an epoxide group of the formula

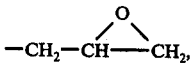

and an isocyanate group of the formula —NCO, and D' is selected from the group consisting of hydrogen, —OH, alkyl radicals of 1 to 3 carbon atoms and oxyalkyl radicals of 1 to 3 carbon atoms; with the provisos that (1) at least one E group must contain at least one —OH group; (2) at least one of $E_1$ and $E_2$ must contain at least one epoxide or isocyanate group; and (3) when $E_1$ and $E_2$ are the same, $E_1$ and $E_2$ must each be $—CO_2R_2$ wherein $R_2$ is a monovalent radical selected from the group consisting of (i) radicals of the formula

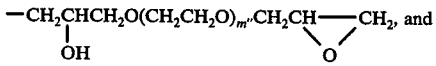

(ii) radicals of the formula

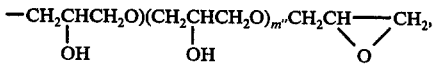

wherein $m''$ is an integer of from 3 to 8;

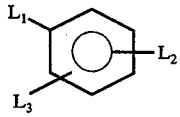

(B)

wherein $L_1$, $L_2$ and $L_3$ are independently selected from the group consisting of $—CON(R_1)_2$ and $—CO_2R_1$ wherein $R_1$ is as defined above, with the provisos that (1) at least one of $L_1$, $L_2$ and $L_3$ must contain at least one —OH group; (2) when $L_1$ and $L_2$ are not the same, at least one of $L_1$, $L_2$ and $L_3$ must comprise $—CO_2R_1$; (3) at least one of $L_1$, $L_2$ and $L_3$ must contain at least one epoxide or isocyanate group; and (4) when $L_1$, $L_2$ and $L_3$ are the same, they are each $—CO_2R_2$, wherein $R_2$ is as defined above;

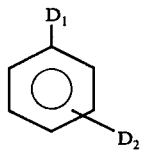

(C)

wherein $D_1$ and $D_2$ are the same or different and are monovalent radicals of the formula $—CO_2R_1$, wherein $R_1$ is as defined above, with the provisos that (1) at least one of $D_1$ and $D_2$ contain at least one —OH group; (2) at least one of $D_1$ and $D_2$ must contain at least one epoxide or isocyanate radical; and (3) when $D_1$ and $D_2$ are the same, they are each $—CO_2R_2$, wherein $R_2$ is as defined above; and with the further provisos that (1) when $T_2$ is $—T_1$ or $—OT_1$, *m' for* $T_2$ cannot be greater than 4; (2) the sum of $p_1$, $p_2$ and $p_3$ must be at least 2; (3) the sum of $p_4$ and $p_5$ must be at least one; and (3) $\Sigma m_i$ must be at least 2; and mixtures thereof.

2. Hydrophilic fiber additives according to claim 1 wherein the additive is soluble in a polar solvent selected from the group consisting of water, methanol and ether solvents.

3. A process for treating fibrous articles from fiber-forming thermoplastic material to provide improved water absorbency and charge dissipation properties, which comprises (1) contacting the fibrous article with liquid organic or aqueous medium containing at least one hydrophilic fiber additive together with at least one nitrogen catalyst under conditions sufficient to incorporate additive and catalyst into the fibrous article and then (2) heating the fibrous article for reaction of said incorporated additive in said fibrous material; said hydrophilic fiber additive comprising a member selected from the group consisting of compounds having per molecule (1) at least two ether linkages, (2) at least one hydroxyl group, and (3) at least one group

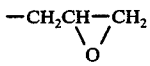

and being as defined in claim 1.

4. The process of claim 3 wherein the fibrous article containing the absorbed additive and catalyst is heated at a temperature of from about 90° to 230° C.

5. The process of claim 4 wherein the fibrous article is heated for a period of from about 5 seconds to about 240 minutes.

6. The process of claim 3 wherein the liquid medium contains said hydrophilic fiber additive in an amount of from about 0.1 to 5 percent by weight.

7. The process of claim 3 wherein the fibrous article is contacted with a first liquid medium containing the nitrogen catalyst and then with a second liquid medium containing the nitrogen catalyst.

8. The process of claim 3 wherein the liquid medium is at a temperature of from about 10° to 60° C. and said fibrous article is contacted with said liquid medium for a period of from about 0.01 to 1 hour.

9. The process of claim 3 wherein the fibrous article to be heated has incorporated therein hydrophilic fiber additive in an amount of up to about 5 percent by weight of the fibrous article.

10. The process of claim 3 wherein the liquid medium is an organic solvent for the selected hydrophilic ether additive.

11. The process of claim 3 wherein the liquid medium contains a dye.

12. The process of claim 3 wherein the fiber-forming thermoplastic material comprises a member selected from the group consisting of polyamide, polyester, polyacrylonitrile and blends thereof.

13. A fibrous article from fiber-forming thermoplastic material having incorporated therein, to provide improved water absorbency and charge dissipation properties, at least one hydrophilic additive, being as defined in claim 1.

14. The fibrous article of claim 13 wherein the fiber-forming thermoplastic material comprises a member selected from the group consisting of polyamide, polyester, polyacrylonitrile and blends thereof.

* * * * *